United States Patent [19]

Hayashi

[11] 4,276,707

[45] Jul. 7, 1981

[54] CARTRIDGE/CARRIER LOCKING DEVICE FOR AUTOMATIC GUN

[75] Inventor: Hisao Hayashi, Tokyo, Japan

[73] Assignee: Kabushiki Kaisha Kawaguchiya Hayashi Juho Kayaku-Ten, Tokyo, Japan

[21] Appl. No.: 943,353

[22] Filed: Sep. 18, 1978

[51] Int. Cl.[3] ..... F41C 13/00

[52] U.S. Cl. ..... 42/17

[58] Field of Search ..... 42/17, 21

[56] References Cited

U.S. PATENT DOCUMENTS

| | | | |
|---|---|---|---|
| 659,507 | 10/1900 | Browning | 42/17 |
| 689,283 | 12/1901 | Browning | 42/17 |
| 1,550,758 | 8/1925 | Swebilius | 42/17 |
| 2,278,589 | 4/1942 | Rutherford | 42/17 |
| 2,418,946 | 4/1947 | Loomis | 42/21 |
| 2,827,728 | 3/1958 | Simmons | 42/17 |
| 4,014,247 | 3/1977 | Tollinger | 42/17 |

*Primary Examiner*—Charles T. Jordan

*Attorney, Agent, or Firm*—Toren, McGeady and Stanger

[57] ABSTRACT

A cartridge/carrier locking device for an automatic gun including a latch plate pivotally mounted on an inner wall of a receiver to pivot in a seesaw like manner to have two ends thereof alternately protrude inside of the receiver. The front end protrudes to restrain a cartridge and the rear end to restrain a carrier. A spring pushes the rear end toward the inside of the receiver. Against this spring, a breechblock and a cartridge brought out of a magazine respectively restrict the protruding motion of the rear end until the breechblock moves backward approximately to a maximum extent. The position at which the breechblock comes to restrict the protruding motion of the rear end of the latch plate is arranged to differ from the position at which the cartridge comes to restrict in such a way as to allow the rear end to lock the carrier.

1 Claim, 8 Drawing Figures

CARTRIDGE/CARRIER LOCKING DEVICE FOR AUTOMATIC GUN

BACKGROUND OF THE INVENTION

1. Field of the Invention

This invention relates to a cartridge/carrier locking device for an automatic gun.

2. Description of the Prior Art

In general, an automatic gun is arranged to perform an automatic loading operation after the gun has been fired, which operation includes the steps of extracting an empty cartridge by backward movement of a breechblock which normally closes the breech face of the barrel, returning the trigger device to its state of preparation for the next firing whilst concurrently the next cartridge is brought out of a magazine and moved toward the chamber of the barrel by an upward sway of a carrier, and loading the next cartridge into the chamber by the forward movement of the breechblock. This series of steps (hereinafter referred to as a cyclic reloading operation of the automatic gun) is accomplished in an extremely short period of time. From the safety viewpoint, it is important that after firing the gun there is a time delay to ensure that the spent cartridge is completely ejected from the receiver containing a trigger device, etc. by an extractor before the next cartridge is pushed up by the carrier towards the breech. In view of the importance of such a delay, an often-used arrangement includes a cartridge lock which normally is attached to the receiver and is used to prevent the next cartridge from leaving the magazine, the cartridges being urged out of the magazine by a spring disposed therewithin. The cartridge lock is released to allow the next cartridge to leave the magazine only when the breechblock fully retracts. In addition, there has to be provided a cartridge locking latch to allow locking of the cartridge lock, and a carrier locking latch which prevents the carrier from making the upward sway until the breechblock has sufficiently retracted to complete ejection of the preceding cartridge and the next cartridge is fully on the carrier.

However, the above described known arrangement requires many component parts and results in a complex construction. In addition to this drawback, it is necessary to have some means for releasing the carrier from the carrier locking latch in order to load the magazine with cartridges, because otherwise the carrier cannot be moved out of the way. This also has been a drawback of some designs.

A study of various prior art automatic reloading firearms has revealed the following points.

(1) When the breechblock has retracted fully inside the receiver and begins to move forward under the action of a recoil spring provided for instance in the stock, so as to return to its initial position, the forward movement of the breechblock urges the carrier to pivot and sway upward to move the next cartridge towards the breech. The pivotting force on the carrier is exerted only by the forward movement of the breechblock.

(2) The restriction on the upward swaying movement of the carrier by a carrier lock is required only until the next cartridge is brought out of the magazine, the breechblock then starting to urge the carrier to move.

(3) Since the barrel chamber must be loaded with the next cartridge shortly after the ejection of the empty cartridge, the next cartridge must be released from the cartridge lock at a stage prior to such loading, though at all other times the cartridge lock must be effective.

(4) Heretofore, for a pivoting carrier, release thereof has been effected by pushing the carrier latch with the bottom rim of the cartridge itself as the cartridge is brought on to the carrier.

The inventor thus has discovered that the best result can be obtained by releasing the cartridge lock either when the retraction of the breechblock reaches about a maximum stroke or slightly earlier than that and, at the same time, by restricting the upward sway of the carrier due to the urging force of the breechblock until the cartridge is completely brought onto the carrier. This discovery has led to the present invention.

Strict restriction on the upward pivoting motion of the carrier is required only during a process of bringing a next cartridge out of the magazine onto the carrier. Naturally, no cartridge lock is required during this process. Assuming that the condition in which the cartridge and the carrier are respectively locked by locking devices is a positive state and the condition in which they are not locked is a negative state, the two locking devices should be in a reversed positive-negative functioning relation. This functional relation between the two locking devices can be satisfied by adapting a single latch plate to move in a seeesaw like manner.

SUMMARY OF THE INVENTION

It is therefore a general object of this invention to provide a cartridge/carrier locking device which eliminates the above stated drawbacks of the conventional devices by the use of a single piece of a latch plate which serves combined purposes of locking a cartridge and a carrier in an automatic gun. To attain this object, the latch plate is pivotally mounted on an inner wall of a receiver to allow two ends of the latch plate to alternately come to protrude to the inside of the receiver. One end of the latch plate is adapted to prevent a cartridge from leaving a magazine while the other end is adapted to lock a carrier against movement. The carrier locking end of the latch plate is allowed to swing to the inside of the receiver (to function as carrier lock and to release the cartridge from locking) only when retraction of a breechblock has nearly reached its maximum stroke. At all other times, the carrier locking end of the latch plate is prevented from swinging into the receiver by the breechblock, the bottom rim of a cartridge or swaying of the carrier so that a cartridge is continuously prevented from leaving the magazine.

It is another object of this invention to provide a cartridge/carrier locking device which prevents an abnormal action of the carrier, such as springing of it, due to a great shock or vibration brought about by the recoil on firing of a cartridge if the carrier is completely released from locking by the latch plate. To attain this object, the position at which the swinging movement of the carrier locking end of the latch plate within the receiver is restricted by the breechblock is arranged to differ from the position at which the swinging movement of the carrier locking end is restricted by the bottom rim of the cartridge in such a manner that: Under the former condition of restriction which is imposed by the breechblock, the carrier locking end of the latch plate is allowed to protrude inside the receiver to a given extent to aid in restricting the upward swaying movement of the carrier. This arrangement prevents the above stated abnormal action of the carrier.

Other objects and aspects of the invention will become apparent from the following description of a preferred embodiment of the invention with reference to the accompanying drawings.

BRIEF DESCRIPTION OF THE DRAWINGS

The accompanying drawings illustrate a preferred embodiment of the present invention.

DESCRIPTION OF THE PREFERRED EMBODIMENT

Figure 1:
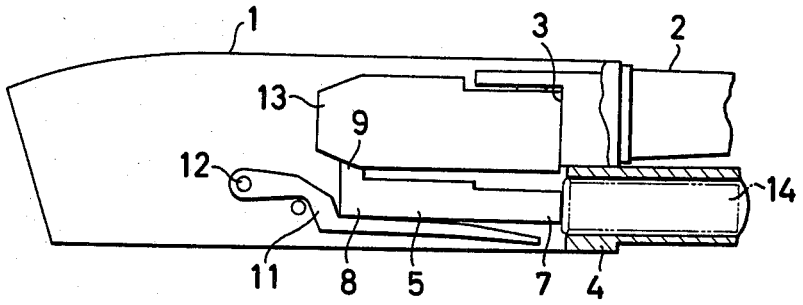
FIGS. 1, 3 and 5 are partly sectional illustrations of a receiver of an automatic gun, FIG. 1 showing it as in a state prior to firing, FIG. 3 showing it as a cartridge is leaving the magazine and FIG. 5 showing a carrier in its active state.

Referring to FIGS. 1 to 5, there is shown a receiver 1 which houses a breechblock 13, a trigger device (not shown) as well as other parts associated therewith. A barrel 2 is secured to the front of the receiver 1, the barrel having a breech face 3. A magazine 4 is secured to the front part of the receiver 1 parallel to the barrel 2, and a latch plate 5 is pivotally mounted on a pin 6 provided in the inner wall of the receiver 1 at a position approximately in the middle thereof and behind the magazine 4. The forward end (cartridge locking end) and the rear end (carrier locking end) of the latch plate 5 alternately protrude within the receiver as the latch plate 5 pivots on the pin 6. A first claw part 7 is formed on the forward end of the latch plate 5 for locking a cartridge, and a second claw part 8 is formed on the rear end of the latch plate 5 for locking a carrier. A third claw part 9 protrudes upwardly from the rear end of the latch plate 5 to come into sliding contact with a side face of a breechblock 13, a spring 10 pushing the rear end of the latch plate 5 towards the inside of the receiver 1. A carrier 11 is disposed inside the receiver 1 in a position behind the magazine 4 and is connected to a trigger guard (not shown) for vertical movement by means of a pin 12 provided at the rear end thereof. The carrier 11 is also connected to a carrier dog (not shown) which is capable of engaging the breechblock in such a way as to urge the carrier to swing upwardly when the breechblock moves forward.

Figure 3:
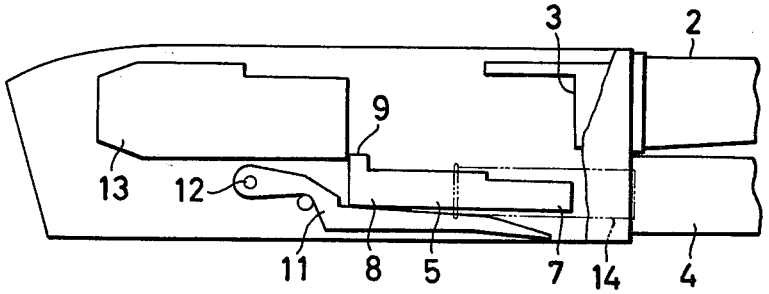

The breechblock 13 is slidably mounted in the receiver to open and close the breech, the breechblock normally closing tightly against the breech face 3 of the barrel 2, as shown in FIG. 1. When the gun is fired, a gas operating device (not shown) transmits a rearward force to the breechblock. This causes the breechblock to retract as shown in FIG. 3 against the action of a recoil-spring (not shown) provided in the stock, and then the spring causes the breechblock to return to its initial position. In the Figures cartridges 14 and 15 are illustrated.

In this embodiment, the side face of the breechblock 13 which prevents the swinging movement of the rear end of the latch plate into the receiver 1 by coming into sliding contact with the third claw part 9 of the latch plate 5 against the spring 10 is provided with a recessed part extending from the front end to the rear end of the breechblock 13. The recessed part includes a first locking face 16 which completely annuls the carrier locking function; a second locking face 17 which permits the carrier locking function to a certain degree; and a tapered face 18 which makes these faces 16 and 17 smoothly continuous.

The above described automatic loading arrangement operates in the following manner.

Figure 2:
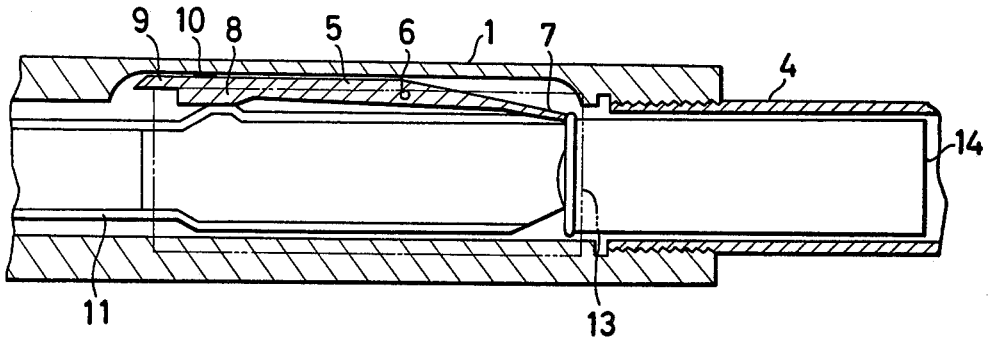
FIG. 2 is a horizontal sectional view through the receiver shown in FIG. 1.

FIGS. 1 and 2 show the condition prior to firing a cartridge. The breechblock 13 is locked in its initial position against the breech face 3 to close the breech. The third claw part 9 of the latch plate 5 is slidably engaged with the first locking face 16 on a side face of the breechblock to urge the first claw part 7 at the forward end of the latch plate inside the receiver 1 against the action of the spring 10. Accordingly, the first claw part 7 is engaged with the cap end of the cartridge 14 to lock the cartridge 14 inside the magazine 4.

Figure 4:
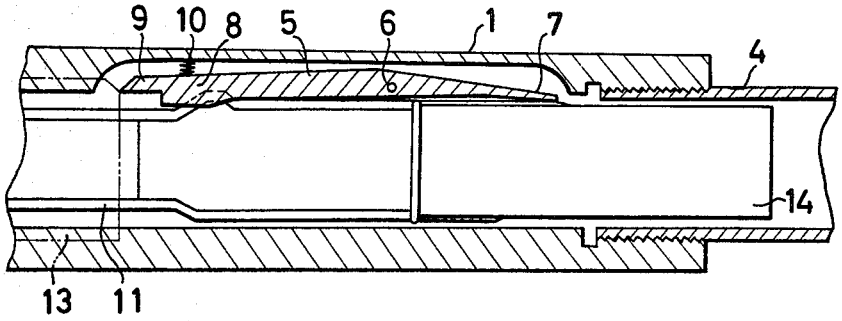
FIG. 4 is a view similar to FIG. 2 but showing the part as in the state of FIG. 3.

Immediately after a cartridge is fired, the breechblock 13 retracts, its engagement with the third claw part 9 of the latch plate 5 thus shifting to the tapered face 18 and to the second locking face 17, and when it approaches the limit of retraction, the third claw part 9 of the latch plate 5 disengages from the breechblock 13 as shown in FIGS. 3 and 4. Then, the face of the spring 10 causes the rear end of the latch plate 5 to swing inside of the receiver 1 to restrict upward pivoting motion of the carrier 11, by means of the second claw part 8. On the other hand, the above-described locking of a cartridge is released as the forward end of the latch plate 5 swings toward the inner wall of the receiver 1. This state continues until the cartridge 14 is moved out sufficiently on to the carrier 11 by a spring (not shown) provided inside the magazine 4. The carrier 11 cannot pivot upwardly during this part of the operation, even if the breechblock commences its forward movement.

Figure 5:
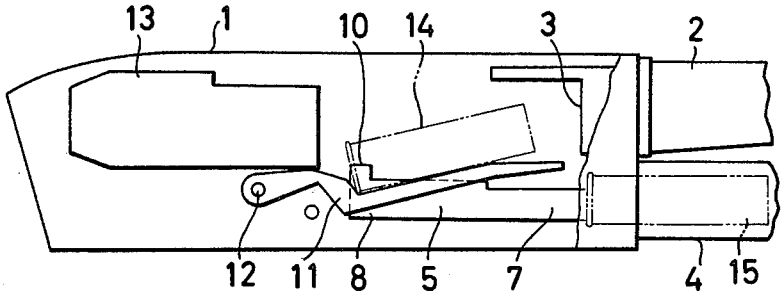
Figure 6:
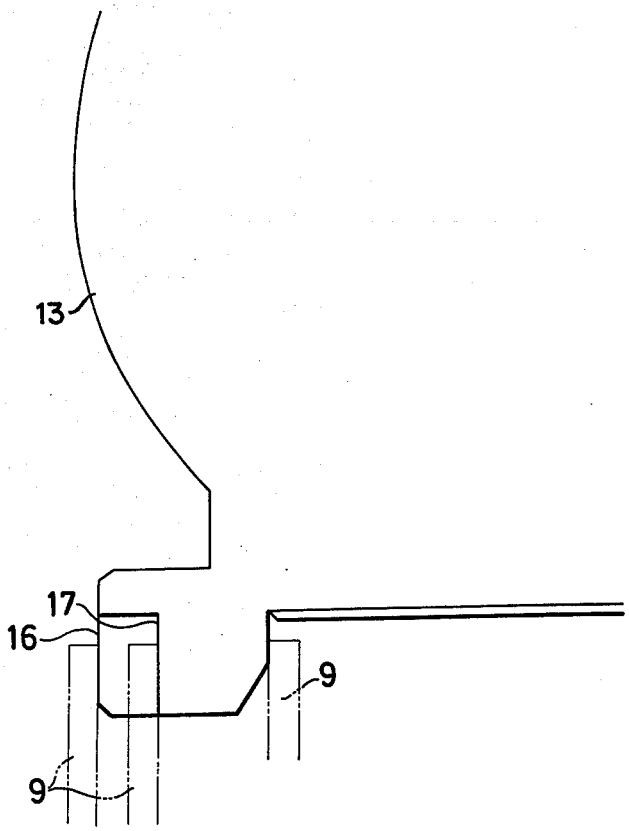
FIGS. 6 and 7 are illustrations of a latch plate sliding part of a breechblock, FIG. 6 being an enlarged side view and FIG. 7 showing the bottom thereof.
Figure 7:
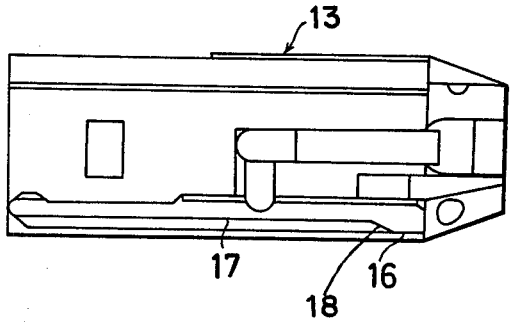

When the cartridge 14 has moved out sufficiently on to the carrier 11, the lower rim of the cartridge 14 pushes the second claw part of the latch plate 5 against the force of the spring 10 to release the carrier lock. Accordingly, the force urging the carrier 11 upwardly immediately causes the carrier 11 to rise and the cartridge 14 is pushed up thereby to the rear part of the barrel 2. At the same time, the side face of the carrier 11 pushes the second claw part 8 of the latch plate 5 as shown in FIG. 5. The cartridge 14 is then sent into the chamber of the barrel 2 by the forward movement of the breechblock 13, which thus again comes to engage with the third claw part 9 of the latch plate 5. By this action, the rear end of the latch plate 5 is continuously held against the force of spring 10 by the rim of the cartridge 14, the side face of the carrier 11 and the side face of the breechblock 13 in turn, one after another. This causes the first claw part 7 located at the forward end of the latch plate 5 to protrude continuously inside the receiver 1 and the next cartridge 15 is locked thereby inside the magazine 4 as shown in FIG. 5.

Figure 8:
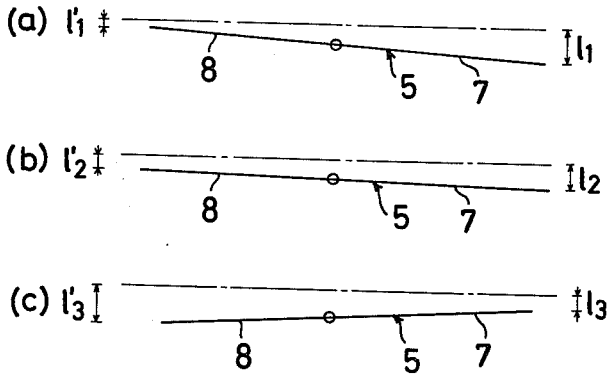
FIG. 8(*a*), (b) and (c) are illustrations of variation in the posture of the latch plate.

During the forward and backward movements of the breechblock 13, the engaging status of the latch plate 5 therewith changes between the first and second locking faces 16 and 17 of the side face of the breechblock 13, as described in the foregoing. This causes variation in the posture of the latch plate 5 as follows:

Referring to FIG. 8, first, the first locking face 16 of the breechblock 13 holds the latch plate 5 in a state as shown in FIG. 8(*a*). When the breechblock begins to retract on firing of a cartridge, the engagement of the latch plate 5 with the breechblock 13 shifts to the second locking face 17 and comes into the state as shown in FIG. 8(*b*). When the breechblock moves backward to its maximum retracting stroke, the latch plate 5 is disengaged from the breechblock 13 to come into the state of FIG. 8(*c*). Then, when the next cartridge is brought out of the magazine, the bottom rim of the cartridge causes the latch plate to come back to the state of (a). The state of (a) continues when the breechblock 13 comes back to its initial position.

The posture of the latch plate thus varies with a cyclic reloading operation of the gun in the sequence of (a)→(b)→(c)→(a). Meanwhile, the protruding degree of the first claw part 7 of the front end of the latch plate 5 inside of the receiver 1 also changes accordingly in the order of l1→l2→l3→l1. Cartridge locking is released only when this protruding degree becomes l3. On the other hand, the protruding degree of the second claw part 8 of the rear end of the latch plate 5 is in a positive-negative reversed relation to this and changes in the order of l'1→l'2→l'3→l'1 to completely release the carrier from its locking action when its protruding degree is l'1; limiting the locking action when the protruding degree is l'2; and totally locking the carrier when the protruding degree is l'3.

As will be appreciated from the foregoing, in the cartridge/carrier locking device of the present invention, a single latch plate is provided, the forward and rear ends of which are arranged to alternately swing into the receiver. The force of spring 10 applied to the rear end of the latch plate urges the rear end of the plate towards the inside of the receiver, though the rear end of the plate cannot move into the receiver during part of the cycle of operation by the presence of the breechblock, the carrier or the cartridge. The rear end of the latch plate is released to move into the receiver only when the rearward movement of the breechblock resulting from firing a cartridge approaches its maximum value. Thus normally the next cartridge is locked in the magazine by the forward end of the latch plate protruding within the receiver, the rear end of the latch plate leaving the carrier unlocked; this condition is reversed only when the backward movement of the breechblock approaches its limit. In this manner, the cartridge locking and carrier locking devices of prior art automatic firearms can satisfactorily be replaced by the single latch plate as described above. This invention thus permits a simplification in the construction and a reduction in the number of required parts.

The arrangement described in the foregoing may be modified by adding, for example, a mechanical switching means for manual operation of the front end part of the latch plate to cause it to pivotally protrude to the inside of the receiver and further to lock the latch plate in that condition. Such modification enables to perform firing and extracting an empty cartridge only without effecting release of cartridge locking by retraction of the breechblock on firing, so that the automatic loading of the next cartridge from the magazine can be restricted as desired.

What is claimed is:

1. An automatic firearm comprising: a barrel having a breech end through which cartridges may be loaded into said barrel; a magazine from which cartridges may be supplied in succession to said barrel; a breechblock movable between a first position closing said breech end of said barrel and a second position for permitting loading of a cartridge from said magazine into said barrel; a carrier mounted for pivotal movement between a first position for receiving a cartridge from said magazine and a second position for moving a received cartridge into loading position relative to said breech end of said barrel; a latch plate having a first end adjacent said magazine and a second end, said latch plate being pivotally mounted intermediate said first and said second ends for movement between a first and a second pivotal position, said first end of said latch plate operating to block removal of cartridges from said magazine when said latch plate is in said first pivotal position; spring means urging said latch plate toward said second pivotal position; first surface means on said breechblock engaging said second end of said latch plate to hold said latch plate in said first pivotal position against the force of said spring means when said breechblock is in its said first position; said breechblock being configured to release said engagement with said latch plate to permit said latch plate to move to said second pivotal position by operation of said spring means when said breechblock is in its second position; carrier engaging means on said second end of said latch plate engaging said carrier when said latch plate is in a position other than said second pivotal position to hold said carrier in said first position; means on said latch plate adapted to be engaged by a cartridge received on said carrier to effect movement of said latch plate against the force of said spring means out of said second position to release said carrier and to thereby permit said carrier to move to said second position to bring a received cartridge into position for loading into said barrel; second surface means on said breechblock engaging said second end of said latch plate when said breechblock is in a position intermediate said first and second positions thereof to permit said latch plate to move to a pivotal position intermediate said first and said second pivotal positions under the force of said spring means; and intermediate surface means on said breechblock extending in a slanted configuration between said first and said second surface means for engaging said second end of said latch plate as said second end moves between engagement with said first and said second surface means of said breechblock.

* * * * *